US007093649B2

(12) United States Patent
Dawson

(10) Patent No.: US 7,093,649 B2
(45) Date of Patent: Aug. 22, 2006

(54) FLAT HEAT EXCHANGER PLATE AND BULK MATERIAL HEAT EXCHANGER USING THE SAME

(76) Inventor: Peter Dawson, P.O. Box 1193, Okotoks, Alberta (CA) T1S 1B2

( * ) Notice: Subject to any disclaimer, the term of this patent is extended or adjusted under 35 U.S.C. 154(b) by 0 days.

(21) Appl. No.: 10/775,381

(22) Filed: Feb. 10, 2004

(65) Prior Publication Data

US 2005/0173103 A1 Aug. 11, 2005

(51) Int. Cl.
*F28F 3/02* (2006.01)
*F26B 17/10* (2006.01)

(52) U.S. Cl. ..... 165/166; 165/79; 165/170

(58) Field of Classification Search ..... 165/164, 165/165, 166, 167, 169, 170, 79, 108
See application file for complete search history.

(56) References Cited

U.S. PATENT DOCUMENTS

| | | | | |
|---|---|---|---|---|
| 3,181,488 | A | 5/1965 | Roe | |
| 3,280,906 | A * | 10/1966 | Rosenblad | 165/166 |
| 3,792,842 | A * | 2/1974 | Nakako et al. | 261/148 |
| 3,847,211 | A * | 11/1974 | Fischel et al. | 165/166 |
| 3,992,168 | A | 11/1976 | Toyama | |
| 4,016,929 | A * | 4/1977 | Pfluger et al. | 165/159 |
| 4,183,403 | A * | 1/1980 | Nicholson | 165/166 |
| 4,276,927 | A * | 7/1981 | Foust | 165/70 |
| 5,400,854 | A * | 3/1995 | Iio et al. | 165/157 |
| 6,293,264 | B1 * | 9/2001 | Middlebrook | 123/563 |
| 6,328,099 | B1 | 12/2001 | Hilt | |
| 6,840,313 | B1 * | 1/2005 | Abiko et al. | 165/166 |

FOREIGN PATENT DOCUMENTS

| | | |
|---|---|---|
| EP | 0265549 | 5/1985 |
| EP | 0546947 | 6/1993 |
| EP | 0952415 | 10/1999 |
| EP | 1036295 | 2/2002 |
| WO | WO03/027592 | 4/2003 |

* cited by examiner

*Primary Examiner*—Tho Duong
(74) *Attorney, Agent, or Firm*—Bay Area Patent Group, LLC

(57) ABSTRACT

A flat heat exchanger plate typically used in a bulk material heat exchanger is provided. The flat heat exchanger plate is designed to operate under a negative internal pressure to eliminate depressions or dimples that are typically formed into the sides of these types of heat exchanger coils during the manufacture process. With the removal of the depressions or dimples the tendency for bulk material to accumulate to the exterior surface of the plate is reduced, thereby increasing the service period of the plate.

15 Claims, 15 Drawing Sheets

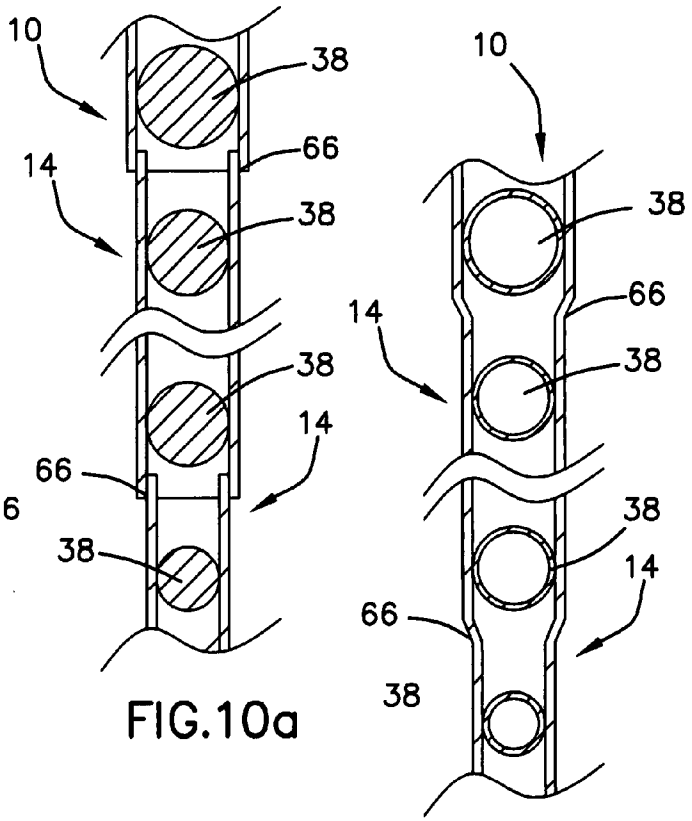
FIG.10b
FIG.10a
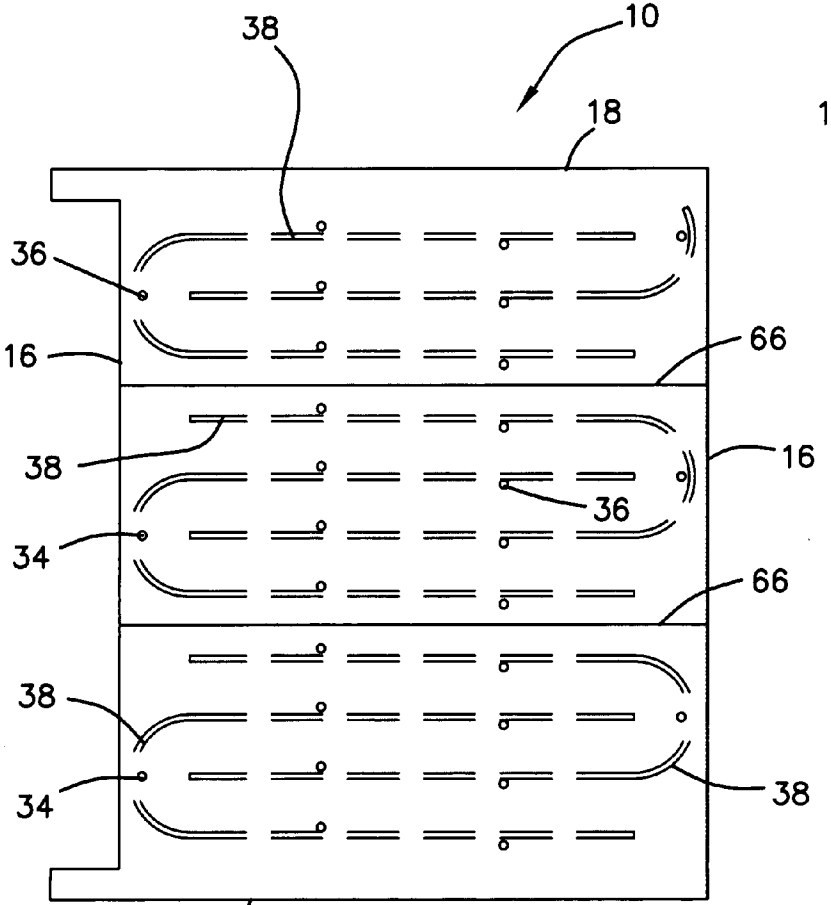
FIG.9

FLAT HEAT EXCHANGER PLATE AND BULK MATERIAL HEAT EXCHANGER USING THE SAME

BACKGROUND OF THE INVENTION

1. Field of the Invention

The present invention relates generally to flat heat exchanger plates for use in heat exchangers. More particularly, relating to flat heat exchanger plates used in bulk material type heat exchangers.

2. Description of the Prior Art

Typically, in processing bulk materials, such as pellets, granules, powders or the like, heat exchangers are employed to either cool or heat the material during the processing thereof. The heat exchangers employed consist of an array of heat exchanger plates arranged side-by-side in spaced relationship and are positioned in an open top and open bottom housing. The like ends of each heat exchanger plate are connected to together by means of a manifold and a heat exchange medium, such as water, oil, glycol or the like is caused to flow through the plates. Generally, the material treated by the heat exchanger is allowed to gravity flow through the housing and the spaces between the spaced plates. During the progression of the material through the heat exchanger, the material is caused to contact the walls of the plates thereby effecting heat transfer between the material and the plates. The rate at which the material flows through the heat exchanger and ultimately across the plates can be controlled by restricting the flow of the material at the outlet of the heat exchanger.

The heat exchanger plates are constructed by attaching metal sheets together along the edges thereof and this is normally accomplished by seam welding the sheets together to form a fluid tight hollow plate. Heretofore, heat exchanger plates have been constructed to operate under internal pressure caused by pumping the heat exchange medium through the plate. To resist internal pressure and to prevent the sides of the plates from deforming, depressions or dimples are formed along the plate. An example of similar heat exchanger plates and their use are described in U.S. Pat. No. 6,328,099 to Hilt et al. and U.S. Pat. No. 6,460,614 to Hamert et al.

During the normal operation of the heat exchanger the bulk material tends to accumulate within the dimples or spot welds and continues to collect to a point where the efficiency of the heat exchanger is greatly reduced and must be cleaned to remove the material residue from the dimples and surrounding exterior surface of the plates. In some circumstances, the material is allowed to collect to a point where the material will bridge between adjacent plates; this not only reduces the heat transfer efficiency of the heat exchanger, but also restricts the flow of the material through the heat exchanger. These circumstances are very undesirable because the operation of heat exchanger must be shut down for a period of time to clean the plates, which many times means the material production line is also shut down, resulting in loss of production and ultimately loss in profits.

Therefore, a need exists for a new and improved flat heat exchanger plate that can be used for bulk material heat exchangers which reduces the tendency for the material to accumulate on the plates. In this regard, the present invention substantially fulfills this need. In this respect, the flat heat exchanger plate according to the present invention substantially departs from the conventional concepts and designs of the prior art, and in doing so provides an apparatus primarily developed for the purpose of increasing the efficiency of bulk material heat exchangers and reducing down time thereof.

SUMMARY OF THE INVENTION

In accordance with the present invention, a flat heat exchanger plate for use in bulk material heat exchangers is provided. The flat heat exchanger plate comprises a plurality of sheets secured together along the edges thereof to form a fluid tight and hollow plate that is generally rectangular in shape. The sides of the plate are substantially smooth and free of depressions, indentations, ridges or the like. The flat heat exchanger plate includes an internal fluid flow passage defined by a plurality of flow diverters, which are positioned within the hollow space of the plate. Heat exchange medium is directed into an inlet nozzle formed in the plate and out of a similarly designed exit nozzle formed in the plate. Unlike a conventional heat exchanger plate, the plate of the present invention is designed to operate under a negative internal pressure opposed to a positive internal pressure. Because the plate is designed to operate under a negative internal pressure the dimples or otherwise depressions formed on the exterior surfaces of prior art plates to withstand internal positive pressure loading are eliminated. In doing so accumulation of material on the exterior surface of the plate is reduced to a very minimal amount.

To withstand the negative pressure within the flat heat exchanger plate, pressure-resisting elements are positioned within the plate and may be unattached or secured to either or both internal surfaces of the sidewalls of the plate. The pressure resisting members or pressure resistor members prevent the sidewalls of the plate from deforming or collapsing inward due to the negative operating pressure present within the plate.

During initial filling of the flat heat exchanger plate with a heat exchange medium or during non-operational periods of the plates, the sides of the plate may tend to bow outward causing the plate to inflate due to the low positive pressure exerted by the heat exchange medium present within the plate in a static state. To prevent this from occurring, pressure restraint members are positioned within the plate and are secured to both sides of the plate, thereby preventing the interior distance between the sides of the plates from increasing.

Flow diverters are positioned within the flow passage of the flat heat exchanger plate and create flow channels for the heat exchange medium to follow. The flow diverters can be formed to any suitable shape from flat stock material or from solid or hollow sectional material and in some applications plastic mouldings could be employed. In addition, the flow diverters can also aid the pressure resistors in preventing the flat heat exchanger plate from collapsing due to internal negative pressures.

An additional advantage of operating the flat heat exchanger plate under negative pressure is the ability to use manifolds that are less expensive and less heavy duty than that of the manifolds required for heat exchanger plates that operate under positive pressure. A lighter duty and less costly manifold, typically a section of pipe or any hollow section material can be used.

In additional embodiments of the flat heat exchanger plate of the present invention, the plate is constructed with tapered sides, which is beneficial in the flow of fine particulate material. The increasing width of the material flow path due to the tapered design of the plate will reduce pressure build-up in the material, thereby making it less likely for particles to accumulate on the sides of the plate.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction, the materials of construction or to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a side elevation view of the tapered embodiment of the flat heat exchanger plate of the present invention.

FIG. 10*a* is a cross sectional view of the plate in FIG. 9.

FIG. 10*b* illustrates an alternate embodiment of FIG. 10*a*.

The same reference numerals refer to the same parts throughout the various figures.

DETAILED DESCRIPTION OF THE INVENTION

Figure 1:
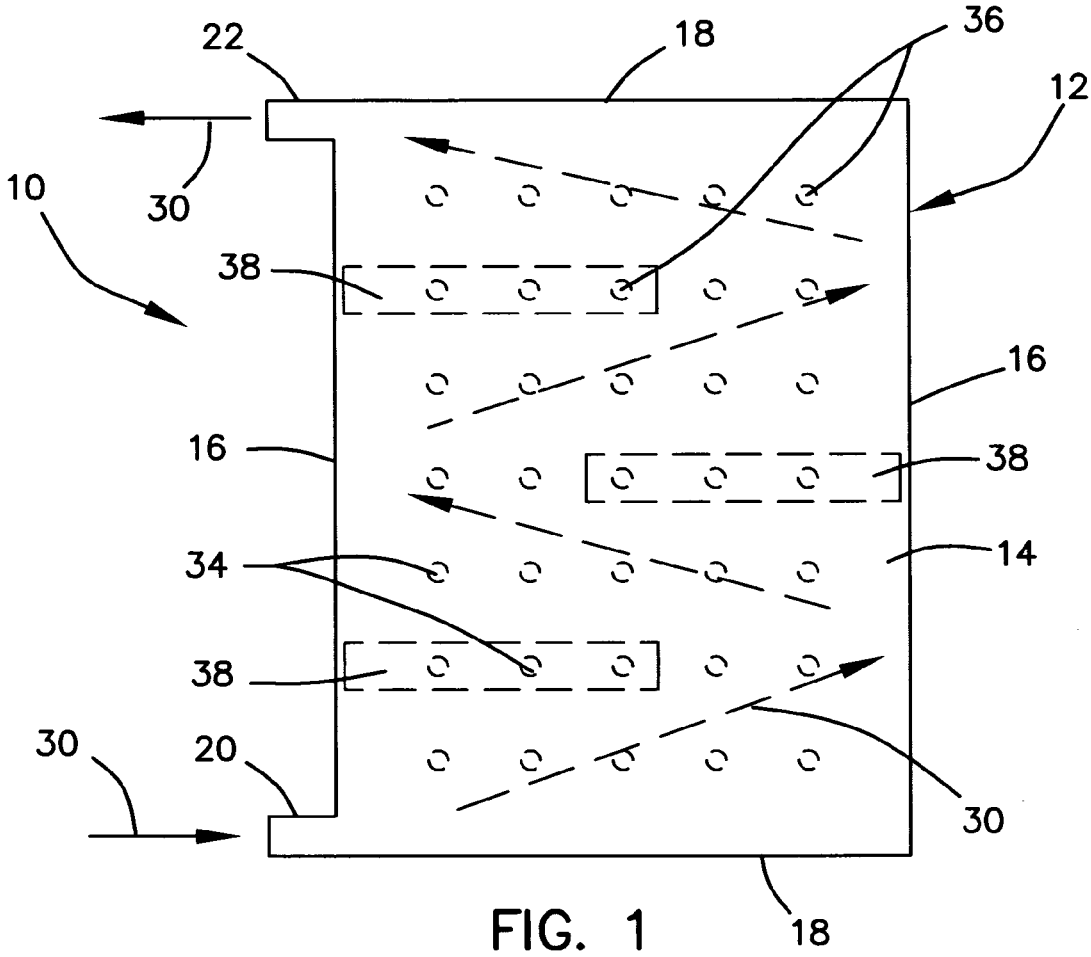
FIG. 1 is a side elevation view of an embodiment of flat heat exchanger plate of the present invention.
Figure 2:
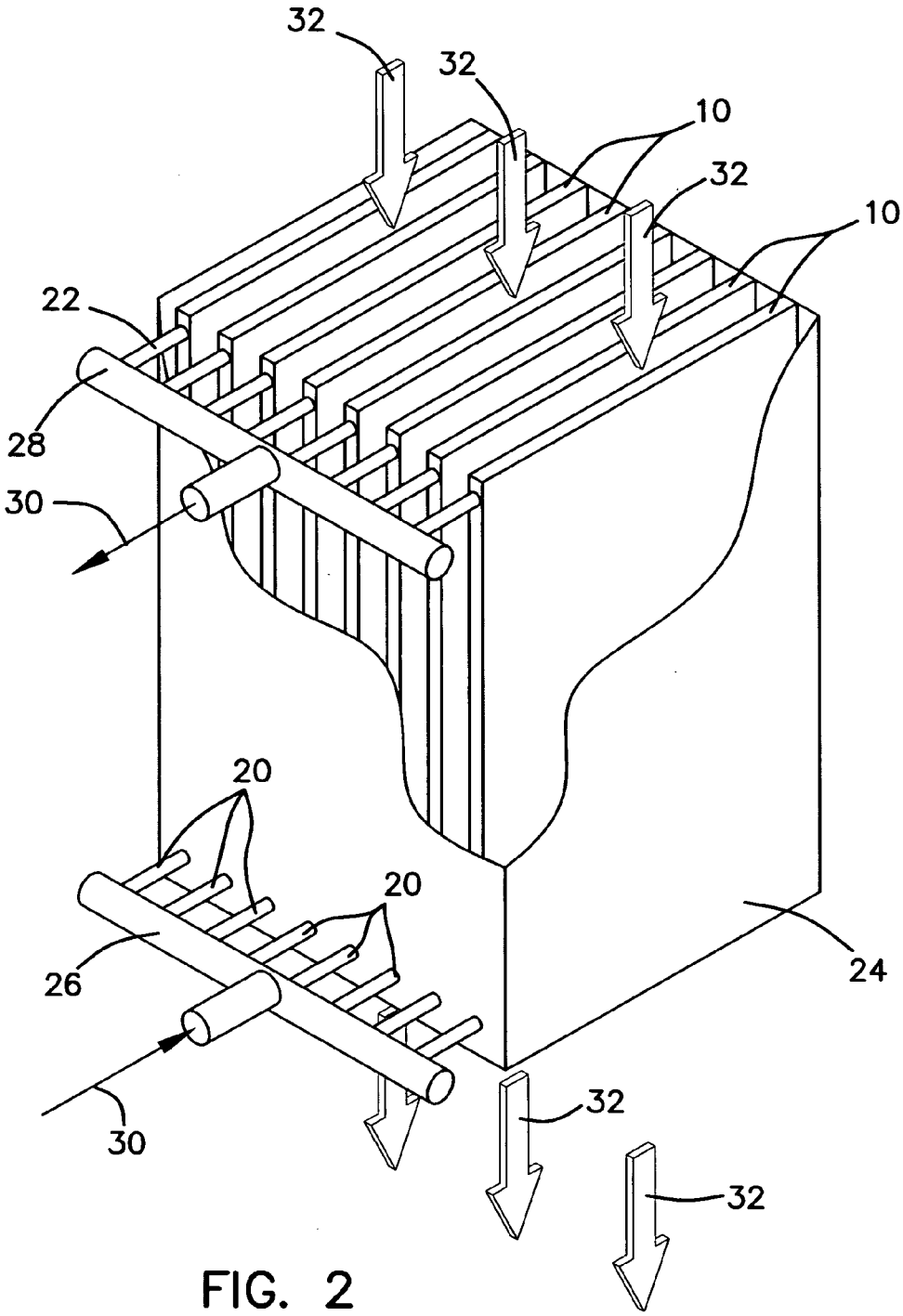
FIG. 2 is an isometric view of the preferred embodiment of the bulk material heat exchanger constructed in accordance with the principles of the present invention in use with the flat heat exchanger plate of the present invention.
Figure 3A:
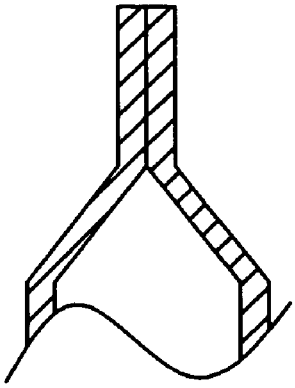
FIG. 3*a* is a cross sectional view of an end of an embodiment of the flat heat exchanger plate of the present invention illustrating one possible method of adjoining the sheets of the plate.
Figure 3B:
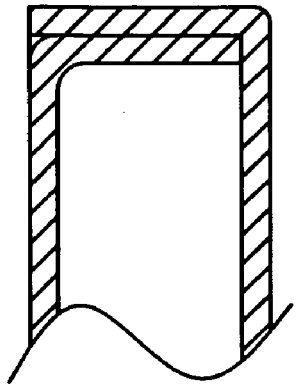
FIG. 3*b* is a cross sectional view of an end of an embodiment of the flat heat exchanger plate of the present invention illustrating a second possible method of adjoining the sheets of the plate.
Figure 3C:
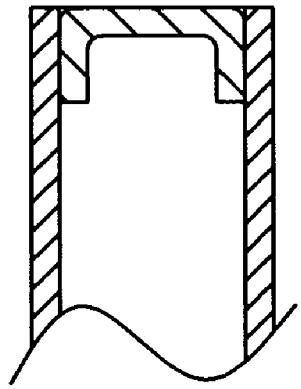
FIG. 3*c* is a cross sectional view of an end of an embodiment of the flat heat exchanger plate of the present invention illustrating a third possible method of adjoining the sheets of the plate.
Figure 3D:
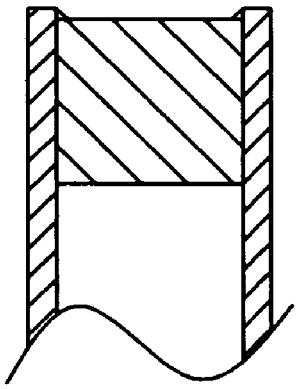
FIG. 3*d* is a cross sectional view of an end of an embodiment of the flat heat exchanger plate of the present invention illustrating a fourth possible method of adjoining the sheets of the plate.
Figure 3E:
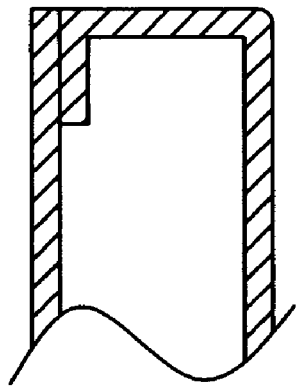
FIG. 3*e* is a cross sectional view of an end of an embodiment of the flat heat exchanger plate of the present invention illustrating a fifth possible method of adjoining the sheets of the plate.

Referring now to the drawings, and particularly to FIGS. 1–2, a preferred embodiment of the flat heat exchanger plate of the present invention is shown and generally designated by the reference numeral 10.

In FIGS. 1 and 2 a new and improved flat heat exchanger plate 10 of the present invention for the purpose of increasing the efficiency of bulk material heat exchangers and reducing down time thereof is illustrated and will be described. More particularly, in FIG. 1, the flat heat exchanger plate 10 has a flat, generally rectangular metal body 12 having two opposing side sheets 14, two opposing longitudinal edges 16, and two opposing transverse edges 18. The two side sheets 14 are sealed to each other along the borders of the two longitudinal and two transverse edges 16 and 18 defining an open interior space. FIGS. 3*a*–3*d* illustrate possible methods of seaming the edges of the flat heat exchanger plate 10. Heat exchange medium inlet and exit nozzles 20 and 22 are provided in fluid communication with the open interior space and can be arranged for example along a common longitudinal edge 16.

Each side sheet 14 is substantially smooth and free of depressions and/or dimples or the like. The phrase "substantially smooth" is to be defined in the context of this application for U.S. Letters Patent as free from ridges, depressions, and dimples or the like created in the sides of the flat heat exchanger plate during the manufacture thereof.

Prior art heat exchanger plates are manufactured with dimples and/or depressions formed on the sides thereof and welded together to increase the resistance of the sides from bowing outward due to a positive internal operating pressure created by pumping a heat exchange medium through the plate. These dimples are a drawback to prior art plates because in service bulk material tends to accumulate in these dimples which has a negative two fold effect. First, the heat transfer between the bulk material and the plate is reduced by a loss of effective surface area of the plate and second the bulk material may be allowed to accumulate to a point where the material bridges between adjacent plates thereby impeding the flow of the material through the heat exchanger. Once this occurs, the heat exchanger must be removed from service and cleaned, which results in undesirable down time of the material production line. To over come the drawbacks of the prior art, the flat heat exchanger plate 10 of the present invention is designed to operate under a negative internal pressure, thereby eliminating the need to create dimples on the sides of the plate.

Turning to FIG. 2, numerous flat heat exchanger plates 10 are illustrated in an exemplary in-use arrangement positioned within a typical bulk material heat exchanger 24. The flat heat exchanger plates 10 are arranged side-by-side in a spaced relationship within the shell of the bulk material heat exchanger 24. The inlet nozzle 20 of each plate 10 is connected to a common heat exchange medium supply manifold 26 and the exit nozzle 22 of each plate is also connected to a common heat exchange medium return manifold 28. The inlet nozzle 20 and the exit nozzle 21 can be formed to any suitable shape, such as but not limited to a rectangle or a circle. In operation, a vacuum source is provided at the heat exchange return manifold 28 and the flow of the heat exchange medium is indicated by arrows 30, where the heat exchange medium enters the supply manifold 26 and is distributed to each of the inlet nozzle 26 of each plate 10. The heat exchange medium is then drawn up and through each plate 10 and ultimately out of the heat exchange medium return manifold 28. Arrows 32 indicate the flow of the bulk material, and the material flows through the heat exchanger and across the plates 10, typically under the force of gravity. With this arrangement, the bulk material heat exchanger 24 operates as a counter flow type heat exchanger.

The flat heat exchanger plate 10 as indicated above, is designed to operate under a negative internal pressure or vacuum as low as about 10 psi (70 kPa) on a vacuum gage. To prevent the side sheets 14 of the flat heat exchanger plate 10 from collapsing at least one pressure resistor member 34 is positioned and strategically arranged within the interior space of the plate. During non-operational periods of the plate 10, a positive internal pressure may be present due to the hydrostatic pressure of the heat exchange medium present within the plate in a static state. To prevent inflation or deforming of the sides of the plate 10, at least one pressure restraint member 36 can be included and is positioned and strategically arranged within the interior space of the plate.

At least one flow diverter 38 is positioned within the flat heat exchanger plate 10 to a create flow passage for the circulating heat exchange medium to flow through. Preferably, flow diverters 38 are arranged to create a serpentine-like flow path for the heat exchange medium. The flow diverters 38 can also aid the pressure resistor members 34 in preventing the sides of the plate 10 from collapsing.

Figure 4:
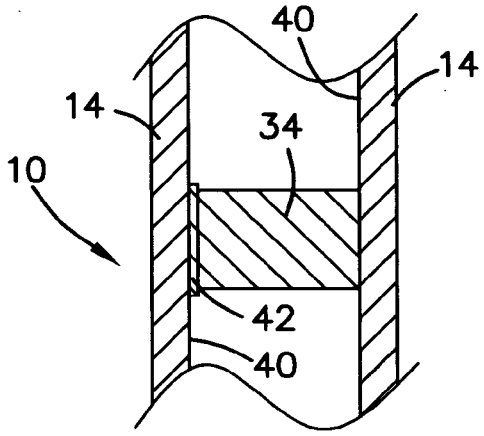
FIG. 4 illustrates a pressure resistor and a possible attachment method thereof to the flat heat exchanger plate of the present invention.

FIG. 4 illustrates a pressure resistor member 34 positioned between the interior surfaces 40 of the side sheets 14 of the flat heat exchanger plate 10. The pressure resistor member 34 is generally cylindrical and is attached at one end to one interior surface 40 of a single side sheet 14. Preferably, the pressure resistor member 34 is attached at one end to the interior surface 40 by a weld 42 with the opposite end of the pressure resistor member free from attachment to the opposing interior surface of the other side sheet. In a preferred embodiment, the pressure resistor member 34 is of a length equal to the distance between the interior surfaces 40 of the plate side sheets 14. In the manufacture of the plate 10, a predetermined number and arrangement of pressure resistors 34 are first attached in a desired pattern to the interior surface 40 of the side sheets 14 before the side sheets are assembled with the plate 10.

Figure 5A:
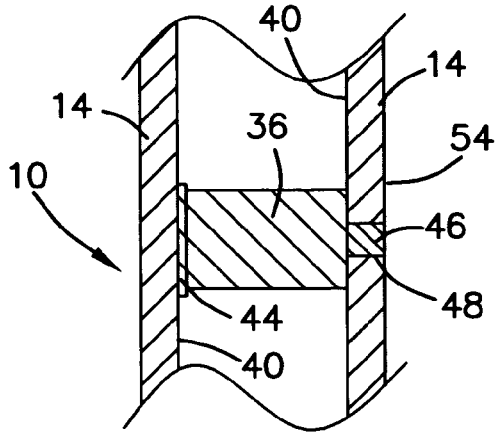
FIG. 5*a* illustrates a pressure restraint member and a possible attachment method thereof to the flat heat exchanger plate of the present invention.

Turning to FIG. 5*a*, one possible embodiment of a pressure restraint member 36 is illustrated and will be described. The pressure restraint member 36 is attached at one end to one interior surface 40 of one side sheet 14 by weld 44. The opposite end of the pressure restraint member is plug welded 46 to the opposite side sheet 14 through a hole 48 formed therethrough and dressed flush with the exterior surface 54 of the side sheet. In this embodiment, the pressure restraint member 36 is cylindrical in shape and is of a length equal to the distance between the interior surfaces 40 of the side sheets 14.

Figure 5B:
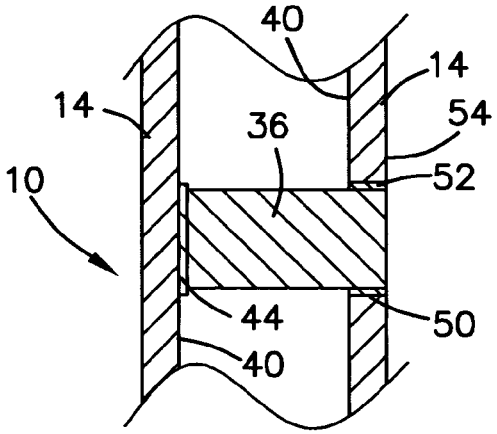
FIG. 5*b* illustrates a pressure restraint member and a possible alternate attachment method thereof to the flat heat exchanger plate of the present invention.

Now turning to FIG. 5*b*, an alternate embodiment of a pressure restraint member 36 is illustrated and will be described. The pressure restraint member 36 is attached at one end to one interior surface 40 of a side sheet 14 by a weld 44. In this embodiment, the pressure restraint member 36 is of a length to pass through a hole 50 formed through the opposite side sheet 14 and is welded 52 around the hole 50. In this application, the weld 52 and the end of the pressure restraint member are dressed flush with the exterior surface 54 of the side sheet 14.

Figure 5C:
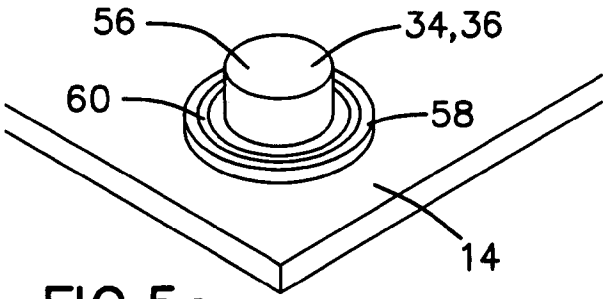
FIG. 5*c* illustrates an alternate pressure resistor attached to a single side of the flat heat exchanger plate of the present invention.
Figure 5D:
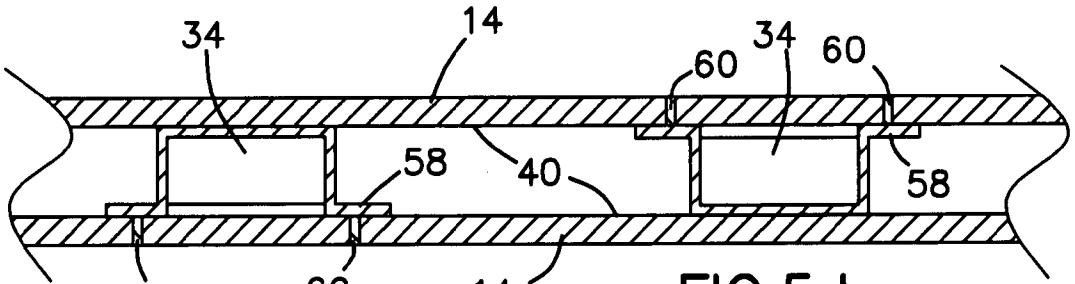
FIG. 5*d* illustrates the pressure resistor of FIG. 5*c* and a possible arrangement method thereof to the flat heat exchanger plate of the present invention.
Figure 5E:
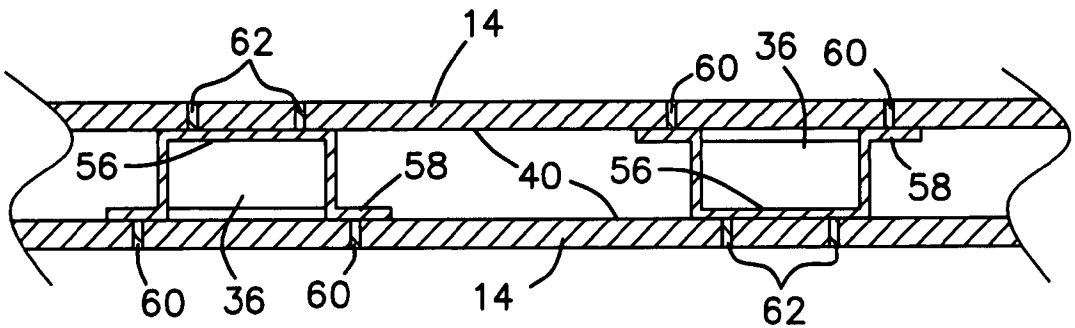
FIG. 5*e* illustrates the pressure resistor of FIG. 5*c* used as a pressure restraint member and a possible attachment method thereof to the flat heat exchanger plate of the present invention.

Referring to FIGS. 5*c*–5*e*, an alternate embodiment of a pressure resistor member 34 and a pressure restraint member 36 is illustrated and will be described. The pressure resistor member 34 and the pressure restraint member 36 have a cylindrical body, closed at one end 56 and a flanged end 58. Application of the pressure resistor member 34 is illustrated in FIG. 5*d*, where the flanged end 58 is attached to the interior surface 40 of one side sheet 14 by a circular weld 60. The pressure resistors 34 can be attached to the interior surfaces 40 of the side sheets 14 in an alternating pattern as illustrated. Application of the pressure restraint member 36 is illustrated in 5*e*, where the flanged end 58 is attached to the interior surface 40 of one side sheet 14 by a circular weld 60. Then on assembly with the other side sheet 14, the cylindrical body 56 is weld thereto by weld 62. The pressure restraint member s 36 can be attached to the interior surfaces 40 of the side sheets in an alternating pattern as illustrated.

Figure 6A:
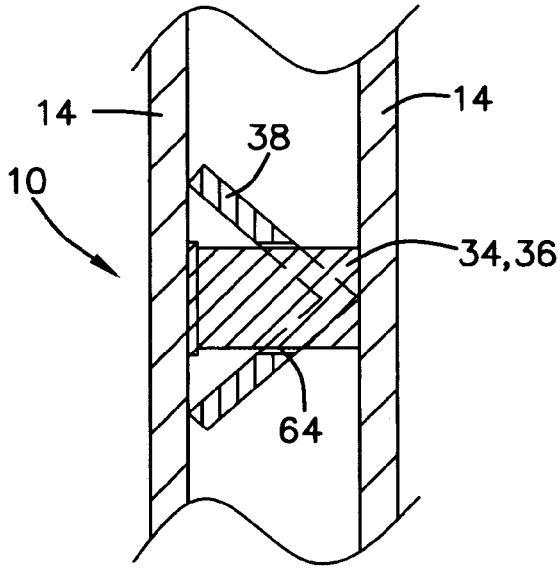
FIG. 6*a* is a cross sectional view taken across a flow diverter of the plate in FIG. 1.

Turning now to FIG. 6*a*, which is a cross sectional view of the flat heat exchanger plate 10 as illustrated in FIG. 1. This figure shows an example of one possible form of a flow diverter 38 positioned within the plate 10 and between the side sheets 14. In this example, the flow diverter 38 is a strip of material having a bend of approximately 90 degrees along a centerline thereof. The flow diverter 38 includes a plurality of holes 64 formed therethrough along the centerline thereof. The holes 64 allow the flow diverter 38 to be positioned about an arrangement of pressure resistors 34 and/or pressure restraint members 36. Referring back to FIG. 1, which illustrates the placement of multiple flow diverters 38 about the pressure resistors 34 and pressure restraint member s 36 to create a serpentine flow path for the heat exchange medium. The positioning of the flow diverters 38 as illustrated is for exemplary purposes only as the flow diverters can be arranged in any manner to create a desired flow path for the heat exchange medium.

Figure 6B:
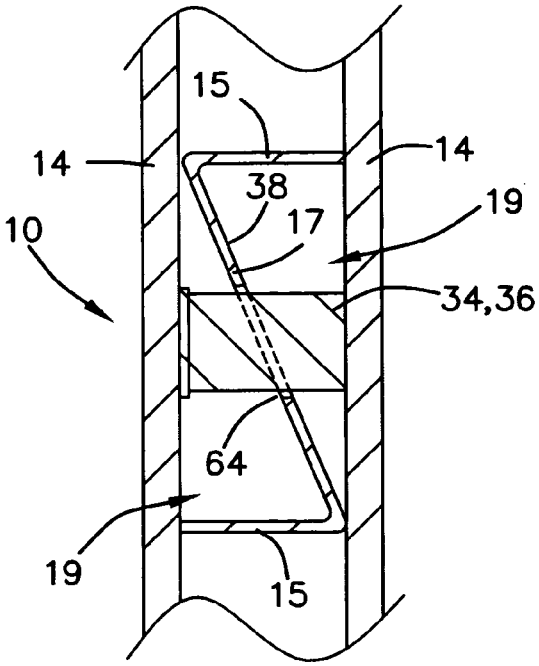
FIG. 6*b* is a cross sectional view taken across an alternate flow diverter of the plate in FIG. 1.

FIG. 6*b* illustrates an example of a combined flow diverter and pressure resistor 38 positioned within the flat heat exchanger plate 10 between the side sheets 14. In this example, the combined flow diverter and pressure restraint 38 is a strip of material having opposed edges bent orthogonal to the side sheets 14 to form two legs 15. These legs act as pressure resistors to prevent the collapse of the plate 10 when operated under a negative pressure. The diagonal web 17 includes a plurality of locating holes 64, and creates to flow passages 19 for the heat exchange medium.

Figure 6C:
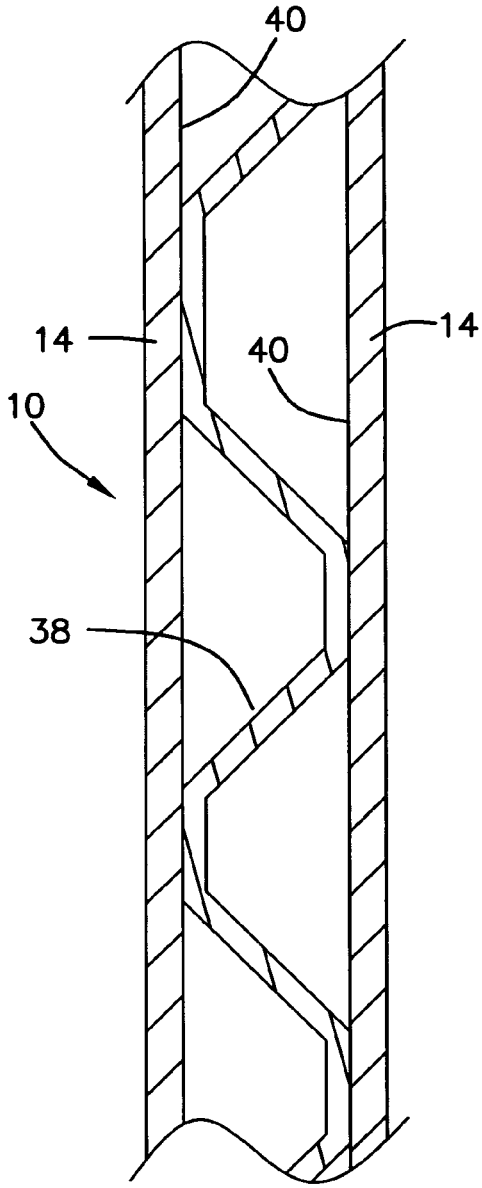
FIG. 6*c* is a cross sectional view taken across an alternate flow diverter of the plate in FIG. 11, discussed below.

FIG. 6*c* illustrates an additional example of a combined flow diverter and pressure resistor 38 in the form of a corrugated formed sheet of material positioned within the flat heat exchanger plate 10 and secured to the interior surfaces 40 of the side sheets 14.

Figure 7:
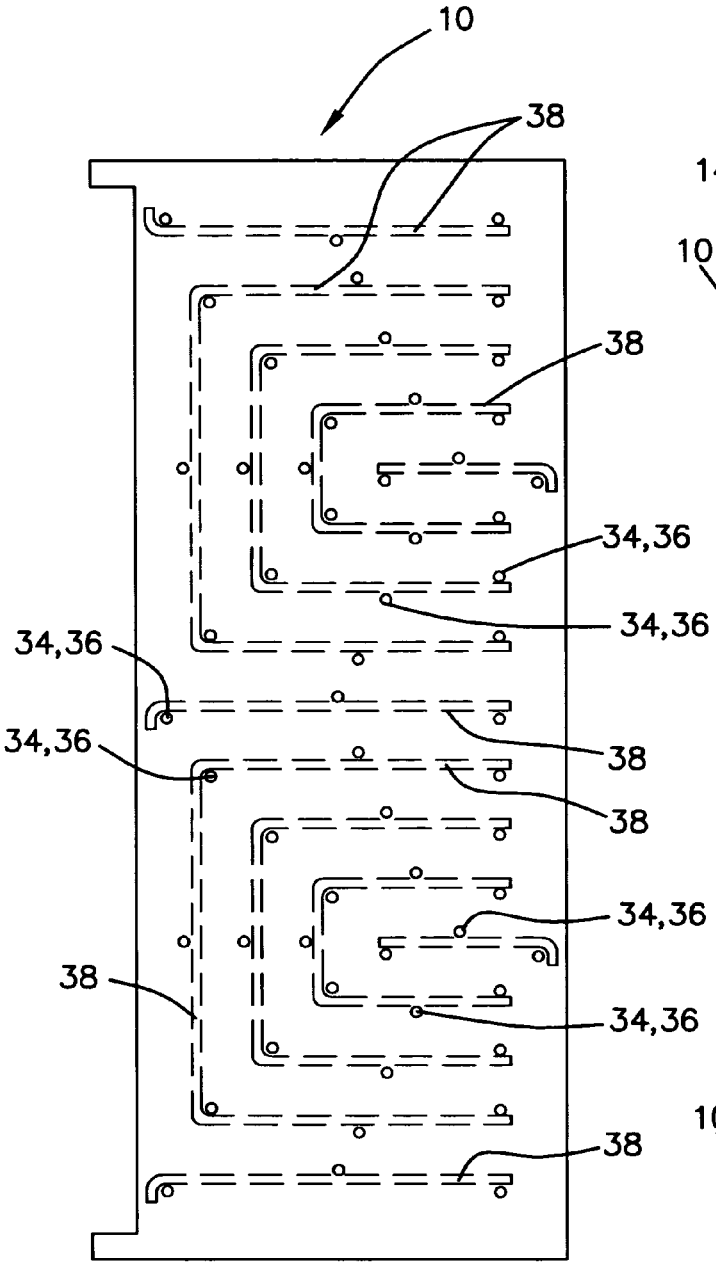
FIG. 7 is a side elevation view of an alternate embodiment of the flat heat exchanger plate of the present invention.
Figure 8A:
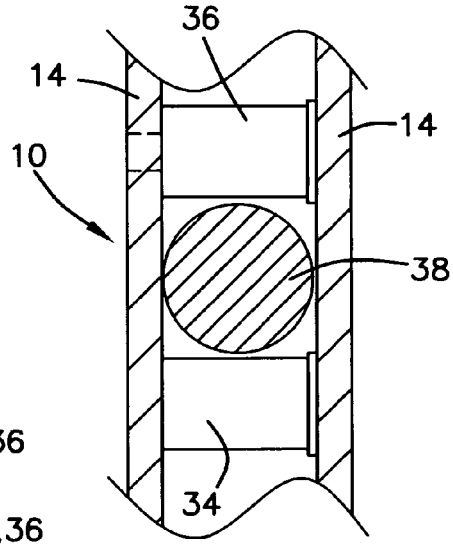
FIG. 8*a* is a cross sectional view taken through a flow diverter of the plate in FIG. 7.
Figure 8B:
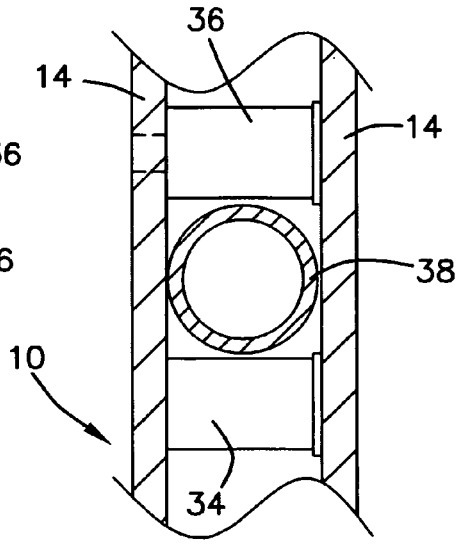
FIG. 8*b* illustrates an alternate embodiment of FIG. 8*a*.

Turning to FIGS. 7, 8*a* and 8*b* an alternate embodiment of the flat heat exchanger plate 10 and flow diverters 38 of the present invention is illustrated and now will be described. In this embodiment, the flow diverters 38 are formed from a solid rod or tube, which are bent and positioned within the plate 10 to create a desired heat exchange medium flow path. The pressure resistors 34 and the pressure restraint member s 36 are strategically positioned and attached to the side sheets 14 of the plate 10 to aid in the correct placement of the formed flow diverters 38. Preferably, the pressure resistors 34 and restraints 36 are positioned to alternate from side to side of the flow diverters 38, as illustrated in FIG. 7. FIG. 8*a* is an enlarged partial cross section of the plate 10 illustrated in FIG. 7 and this figure shows a flow diverter formed from a solid rod and illustrates the method of positioning the pressure resistors 34 and/or restraints 36 on opposite sides of the flow diverter 38 to aid in the positioning and retention thereof. FIG. 8*b* illustrates an alternate embodiment of the flow diverter 38 illustrated in FIG. 8*a*. In this embodiment, the flow diverter is a tube. The flow diverters 38 illustrated in FIGS. 7, 8*a* and 8*b* are of a material having a circular cross section for exemplary purposes only and should not limit the possibility of using material of other cross sectional shapes.

Referring now to FIGS. 9, 10*a* and 10*b*, which illustrate an additional embodiment of the flat heat exchanger plate 10 of the present invention. In this embodiment the thickness of the plate 10 decreases in the direction from one transverse edge to the second transverse edge. Preferably, the thickness of the plate 10 decreases in the direction of the flow of bulk material across the coil. Preferably in this particular embodiment incremental steps 66 decrease the thickness of the plate 10. Most preferably, the steps 66 and thickness of the plate 10 correspond with the various diameters of rod or tube used for the flow diverters 38. FIG. 9 also illustrates an additional possible arrangement of the flow diverters 38 to create a serpentine flow path for the heat exchange medium. As in all of the aforementioned embodiments of the flat heat exchanger plate 10, the flow diverters in this embodiment can aid the pressure resistors 34 in preventing the side sheets 14 of the plate 10 from collapsing. During the manufacture of this embodiment of the flat heat exchanger plate 10 the longitudinal edges 16 are cut to match the step profile of the side sheets 14 of the plate. Preferably, the longitudinal edges 16 are laser cut to match the step profile of the side sheets 14.

FIG. 10*a* is a side elevation view illustrating an example of one method of creating a tapered flat heat exchanger plate 10. In this example, the side sheets 14 of the plate 10 are formed by overlapping sections of sheet metal 68, as illustrated, which are then welded together. The thickness of the flow diverters 38 are equal to the distance between the interior surfaces 40 of the side sheets 14 for each step 66 of the plate 10. For exemplary purposes only, the flow diverters in this figure are illustrated as solid rods.

FIG. 10*b* illustrates a side elevation view illustrating an example of a second method of creating a tapered flat heat exchanger plate 10. In this example, a single sheet is used for each side sheet 14 and the sheet is bent inward at various positions along the length thereof to create the required stepped profile of the side sheet. The thickness of the flow diverters 38 are equal to the distance between the interior surfaces 40 of the side sheets 14 for each step 66 of the plate 10. For exemplary purposes only, the flow diverters in this figure are illustrated as tubes.

Figure 11:
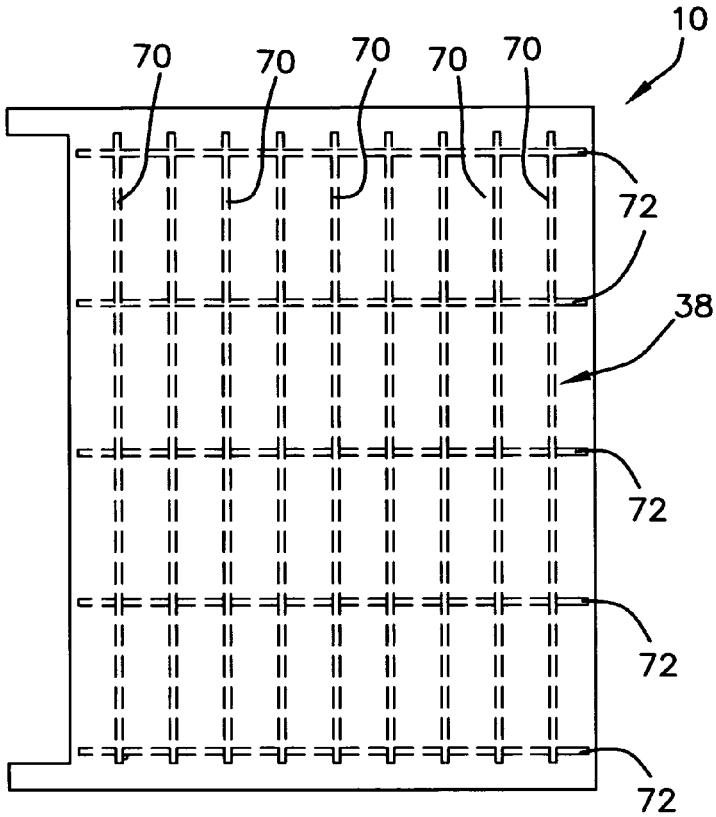
FIG. 11 is a side elevation view of an alternate embodiment of flat heat exchanger plate of the present invention.
Figure 12:
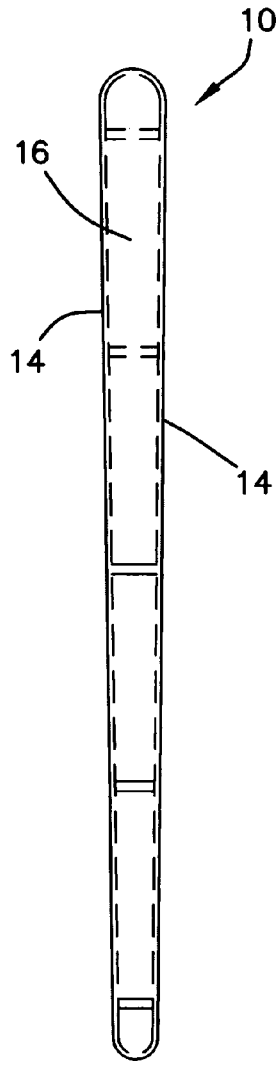
FIG. 12 is a front elevation view of the flat heat exchanger plate of FIG. 11.
Figure 13A:
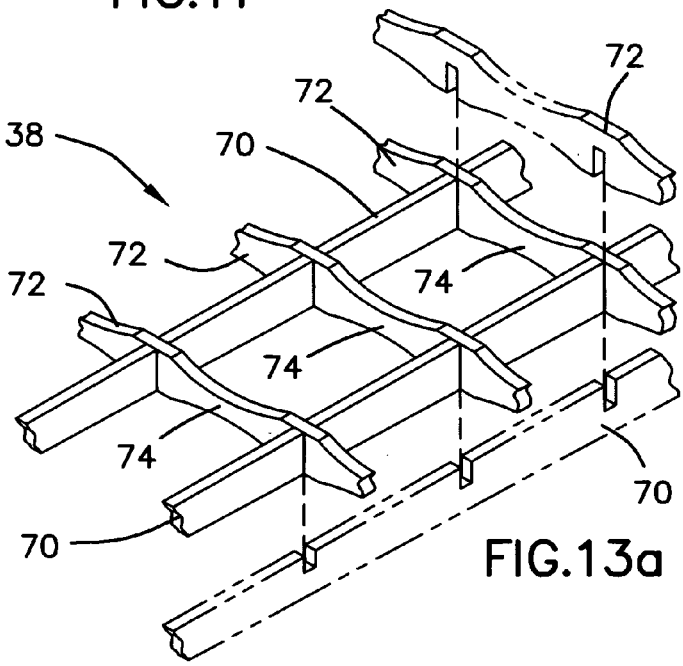
FIG. 13*a* is an isometric view of an alternate embodiment of a combined flow diverter and pressure resistor of the present invention.

Referring now to FIGS. 11, 12 and 13, which illustrate a third embodiment of the flat heat exchanger plate 10 of the present invention and an additional example of a flow diverter assembly 38 for use with a tapered or parallel plate. The flow diverter assembly 38 of this embodiment includes a plurality of tapered flow diverter strips 70 which are interlocked with a plurality of flow control strips 72. Preferably, the flow control strips 72 and the tapered flow diverter strips 70 are interlocked orthogonal to each other. The flow control strips 72 include a plurality of reduced sections 74, which are formed to be positioned between adjacent tapered flow diverter strips 70 and serve to control the amount of heat exchange medium that passes each flow control strip. The flow diverter 38 of this embodiment is also used to prevent the tapered plate 10 from collapsing under negative operating pressure. Pressure restraint members 36 (not illustrated) may also be used in the same manner as described previously to prevent inflation of the plate 10 and to help position the flow diverter 38 within the plate.

Figure 13B:
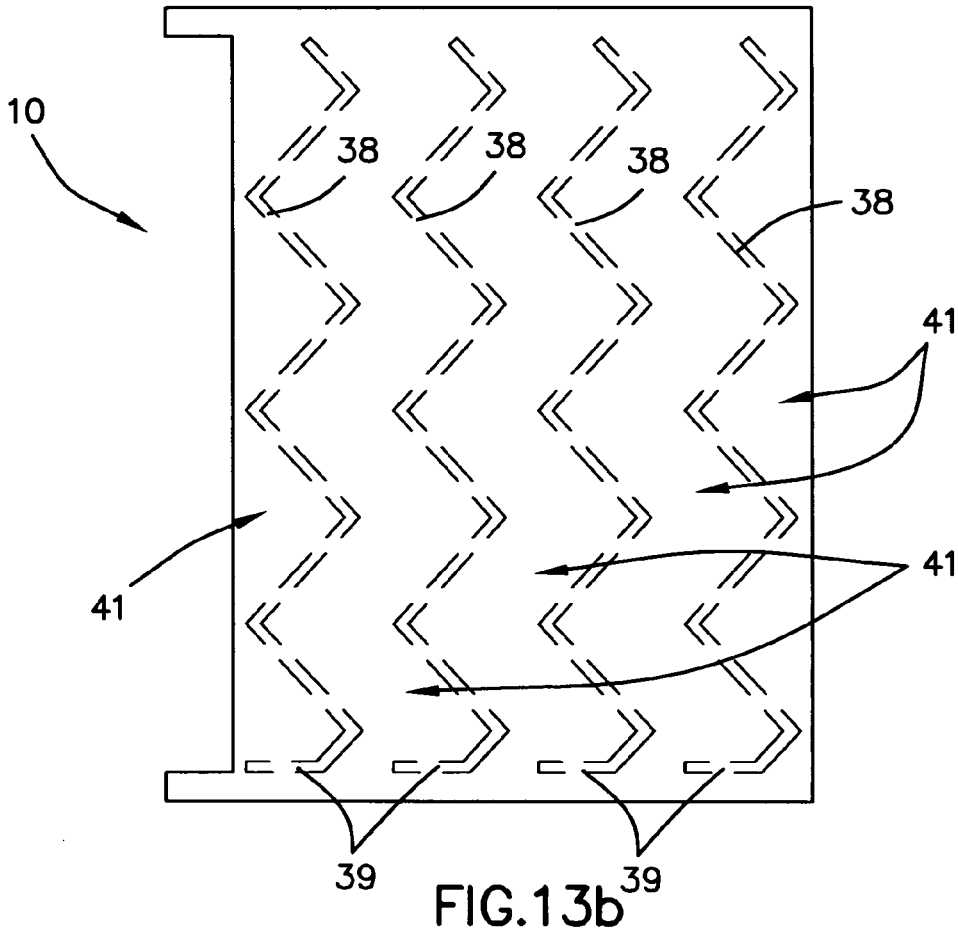
FIG. 13*b* is a front elevation view of an alternate embodiment of the flat heat exchanger plate of the present invention.
Figure 13C:
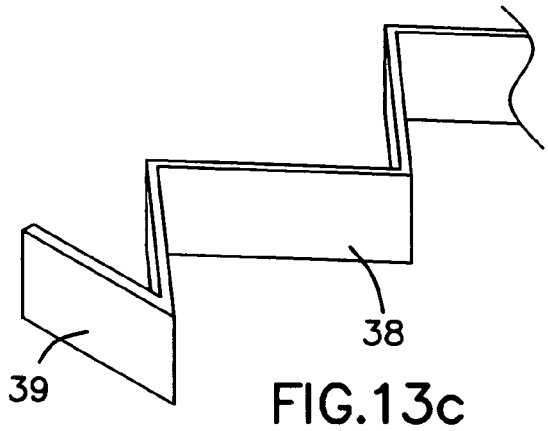
FIG. 13*c* is an isometric view of an alternate combined flow diverter and pressure resistor of the plate in FIG. 13*b*.

Referring to FIGS. 13*b* and 13*c*, which illustrate a fourth embodiment of the flat heat exchanger plate 10 of the present invention and an additional example of a plurality of flow diverters 38 for use with tapered or parallel flat heat exchanger plate. The flow diverter 38 of this example is a tapered or parallel strip of material formed in a serpentine shape and includes a heat exchange medium flow control leg 39. The flow control leg 39 restricts the flow of heat exchange medium into each chamber 41 to ensure an even flow rate of heat exchange medium within each chamber across the plate. The flow diverter 38 of this example is also used to prevent the plate 10 from collapsing under negative operating pressure. In addition to the flow diverters 38, pressure restraint members 36. not illustrated, can be used in the same manner as previously described to prevent inflation of the plate 10 and to aid in the positioning of the flow diverters 38 within the plate.

Figure 15:
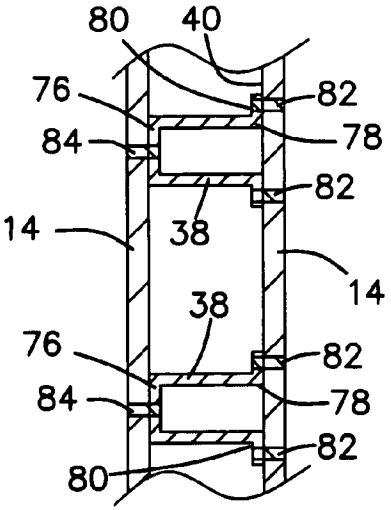
FIG. 15 is a cross sectional view of the plate in FIG. 14.
Figure 14:
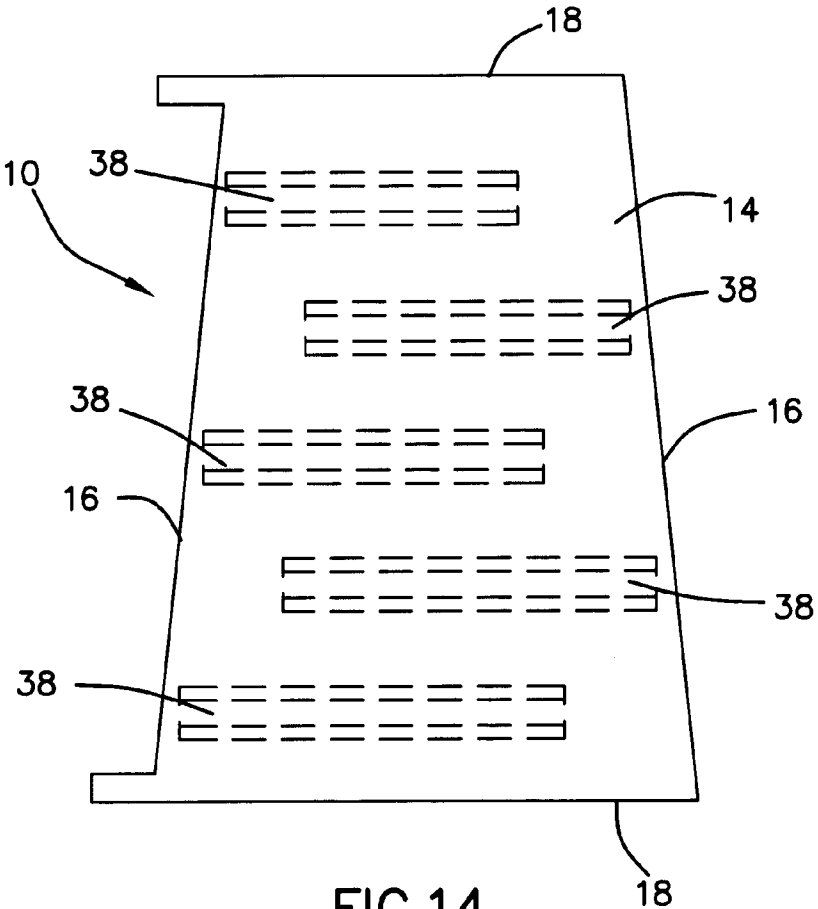
FIG. 14 is a front elevation view of an alternate embodiment of the flat heat exchanger plate of the present invention.

Turning to FIGS. 14 and 15 a fifth method of creating a tapered flat heat exchanger plate 10 is illustrated. The flat side sheets 14 are in parallel planes and increase in width in a direction from one transverse edge 18 of the plate 10 to second transverse edge 18 of the plate. Preferably, the thickness of the plate 10 remains constant along the length of the plate. The gradual increase in width of the plate 10 creates a greater volume between adjacent plates in a bulk material heat exchanger, which releases pressure build-up in particulate material flowing through the heat exchanger. The flow diverters 38 of this example are of an open channel material having a closed side 76 and an open side 78 that includes a pair of flanges 80. The flat heat exchanger plate 10 is constructed by first attaching a plurality of flow diverters 38 to the interior surface 40 of one side sheet 14 by welds 82. The plurality of flow diverters 38 are attached to the side sheet 14 in a desired pattern to create a flow path for the heat exchange medium. Then the second side sheet 14 is attached to the plate 10 and the flow diverters 38 by welds 84 from the exterior side of the second sidewall. Preferably, the welds are laser welded. This method of construction provides for the placement of the flow diverters 38 within the plate and allows the flow diverters to function as pressure resistors and restraints.

Figure 16:
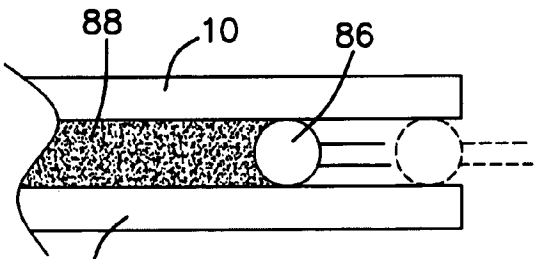
FIG. 16 illustrates the method of incorporating a removable seal between adjacent flat heat exchanger plates.

Now turning to FIG. 16, a removable seal 86 may be positioned between adjacent flat heat exchanger plates 10 to retain the flow of material 88 therebetween. The seal may be removed to help facilitate the cleaning of the plates 10 or by adjusting the vertical angle of the seal to control the flow of material 88 between the plates.

Figure 17:
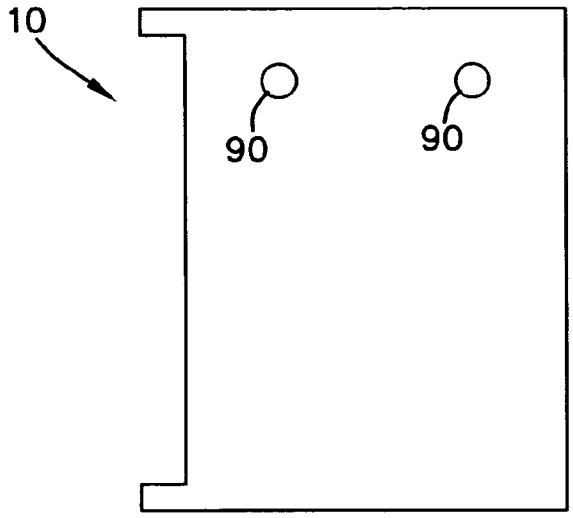
FIG. 17 is a side elevation view of an embodiment of the flat heat exchanger plate of the present invention illustrating the typical placement of support holes for supporting the plate.
Figure 18:
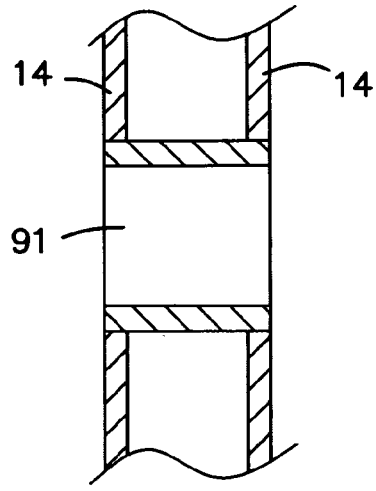
FIG. 18 is a cross sectional view of one support hole of FIG. 17.

Referring to FIGS. 17 and 18, which illustrate a typical placement of support holes 90 through the flat heat exchanger plate 10. The support holes 90, which may be of any desired shape, are formed through both side sheets 14. A tubular sleeve 91 is placed in the support holes 90 then welded to both side sheets 14 and then dressed flushed with the exterior surfaces of the side sheets. The support holes 90 are typically used in supporting the flat heat exchanger plate 10 within a heat exchanger.

Figure 19:
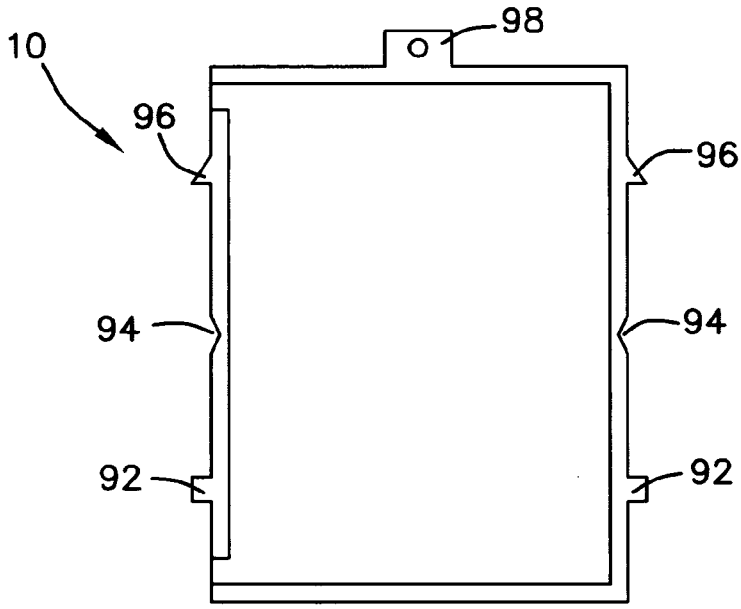
FIG. 19 is a side elevation view of an embodiment of the flat heat exchanger plate of the present invention illustrating a typical placement of location lugs, indents, support lugs and lifting lug for the plate.

Now turning to FIG. 19, which illustrates the capability of incorporating the placement of location lugs 92, which extend from the ends of the flat heat exchanger plate 10, indents 94 formed into the ends of the plate, support lugs 96 extending from the edges of the body of the plate and a lifting lug 98 extending from the top of the plate. Currently, plate heat exchangers are manufactured with supports below the plates which can impede the flow of bulk material and also increase the overall height of the heat. The incorporation of location lugs 92, indents 94, support lugs 96, or a lifting lugs 98 eliminates the need for the supports below the plates 10 and improves the flow path for the bulk material. The overall height of the heat exchanger can be reduced correspondingly.

Figure 20B:
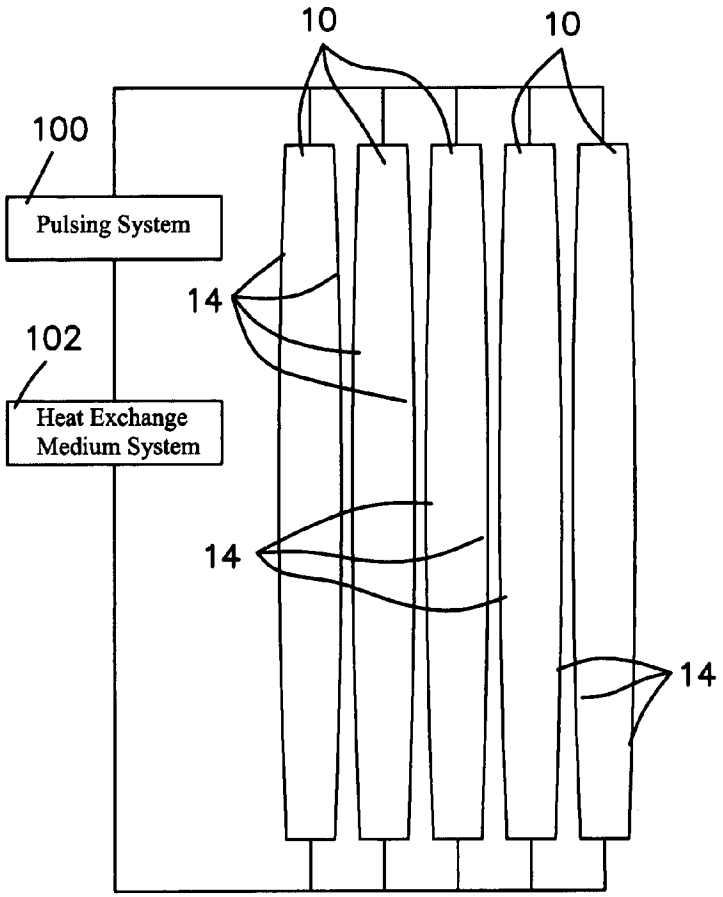
FIGS. 20*a* and 20*b* illustrate a method of automated cleaning of the flat heat exchanger plates of the present invention.
Figure 20A:
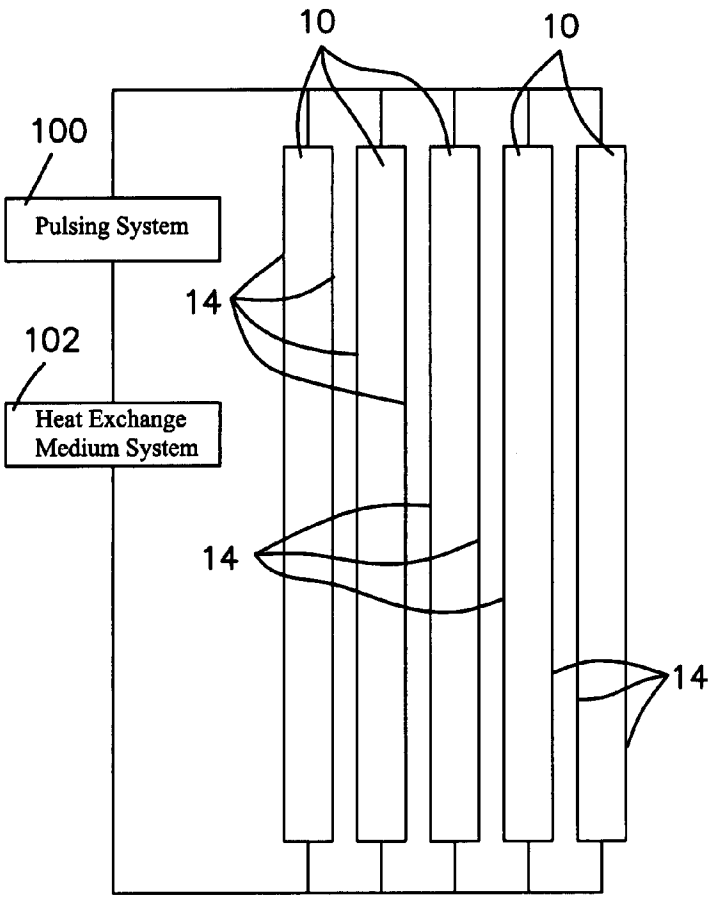

Referring to FIGS. 20*a* and 20*b*, an additional embodiment the flat heat exchanger plate 10 is illustrated and will be described. In this embodiment, the flat heat exchanger plate 10 is designed and manufactured such that upon removal of the negative operating pressure the flat heat exchanger plate sides 14 will slightly inflate due to a positive internal pressure created exerted by the heat exchange medium. Isolating the vacuum source and allowing the heat exchange medium to develop a desired hydrostatic pressure within the flat heat exchanger plates 10 can achieve the slight inflating of the plate coil sides 14. Upon reestablishing the negative operating pressure, the flat heat exchanger plate sides 14 return to a non-inflated position. Preferably, the hydrostatic pressure is allowed to reach a about 5 PSI (34 kPa) and is only applied for a short duration. The duration is at least 1 second. Preferably the duration is from about 1 to about 10 seconds and most preferably, the duration is about 5 seconds. An automated pulsing system 100 can be incorporated in the heat exchange medium system 102 to cause the inflation-deflation cycle of the flat heat exchanger plates 10 at a predetermined frequency.

Incorporating the above cyclic inflation of the flat heat exchanger plates 10 in, for example a bulk material heat exchanger would be beneficial in processing fine particulate materials which tend to bridge across narrow spaces such as the gaps between adjacent flat heat exchanger plates, which creates blockages in the flow of the material. By inflating the flat heat exchanger plate sides 14 by a small fraction of an inch the gap between adjacent flat heat exchanger plate decreases thus compressing any bulk material in the gap. On returning the flat heat exchanger plate sides 14 to the non-inflated position, the gap between adjacent flat heat exchanger plate increases to the normal operation gap and the compressed bulk material is dislodged from the sides. This system provides for the automated, self-cleaning of flat heat exchanger plates 10, which reduces operating costs and service time of the flat heat exchanger plates.

Figure 21A:
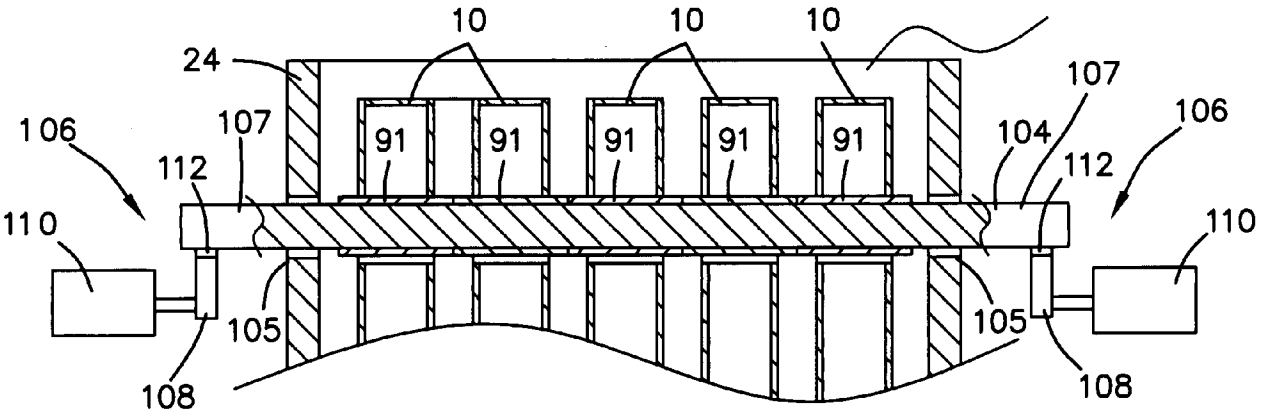
FIGS. 21*a*, 21*b* and 21*c* illustrate an alternate method of automated cleaning of the flat heat exchanger plates of the present invention.
Figure 21B:
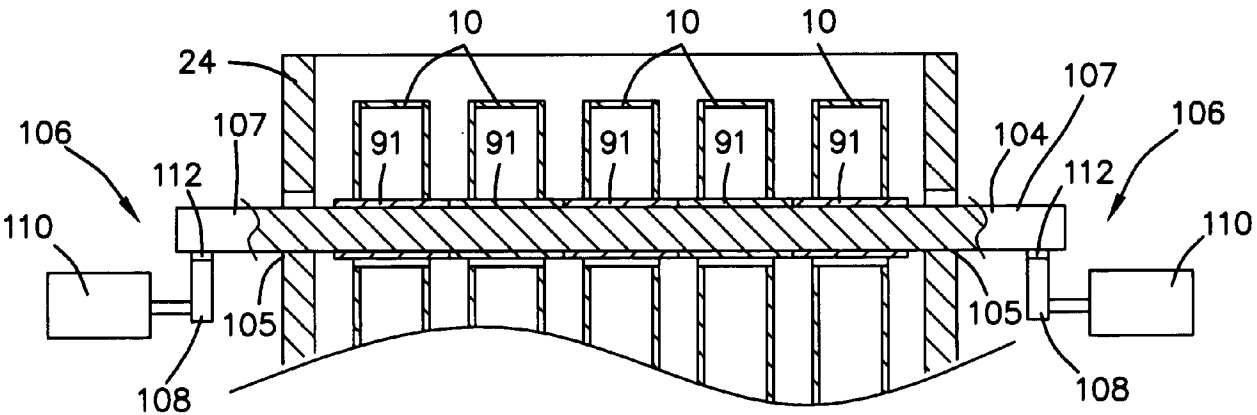
Figure 21C:
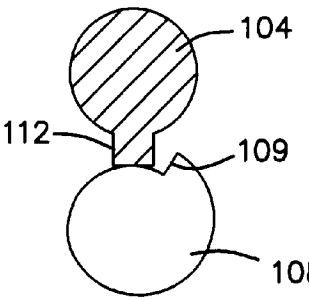

In an additional embodiment of the flat heat exchanger plate system of providing automated, self-cleaning flat heat exchanger plate 10 is illustrated in FIGS. 21*a*, 21*b* and 21*c*.

In this embodiment, the self-cleaning system includes a lift means 106 for lifting the flat heat exchanger plate 10 to aid in the removal of any bulk material that has accumulated on the exterior surfaces of the flat heat exchanger plate. In one example, the flat heat exchanger plate 10 are supported on a bar 104 passing through sleeves 91, which can be extended as illustrated to maintain the flat heat exchanger plate spacing. Referring back to FIG. 2, a flexible connection is incorporated between the flat heat exchanger plate inlet nozzles 20 and the inlet manifold 26, and a similar flexible connection is incorporated between the flat heat exchanger plate exit nozzles 22 and the outlet manifold 28. In FIGS. 21*a* and 21*b*, the ends of the bar 104 are supported by the casing of the bulk material heat exchanger 24. The lift means 106 for lifting and rapidly dropping the bar 104 and the flat heat exchanger plates 10 is attached to the bar. The lift means 106 would raise the bar 104 off of its supports 105 by a fraction of an inch, as illustrated in FIG. 21*a* and then allowed to fall under the effect of gravity back onto the supports as illustrated in FIG. 21*b*. By the lift means 106, the flat heat exchanger plates 10 supported by the bar 104 are raised and dropped resulting in developing a shock wave through the flat heat exchanger plate. The resultant shock wave will dislodge any present bulk material blockage between adjacent flat heat exchanger plates 10.

The lift means 106 could incorporate, for example a cam 108 that is driven by motor 110. The cam 108 is in contact with the cam follower 112 attached to the end 114 of the bar 104. The cam 108 can include a gradual lift profile about a predetermined number of degrees of rotation and a flat profile about a predetermined number of degrees of rotating. FIG. 21*c* illustrates an example of a cam profile that could be used. The lift profile of the cam 108 will gently raise the support bar 104 and the flat heat exchanger plates 10 to a maximum predetermined lift that is a fraction of an inch. The flat profile 109 of the cam 108 will cause the bar 104 to free fall under the force of gravity the distance it was originally raised causing the bar to impact its support 105, thereby forming a shock wave through the flat heat exchanger plates 10.

Figure 22B:
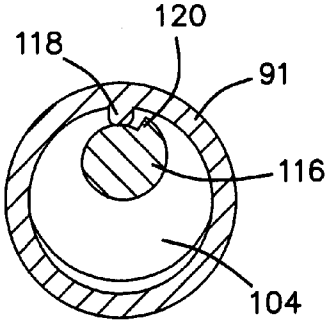
FIG. 22*b* illustrates one possible cam arrangement for use in the method of automated cleaning of the flat heat exchanger plates illustrated in FIG. 22*a*.
Figure 22C:
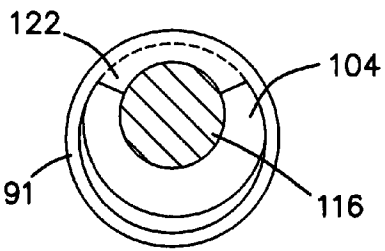
FIG. 22*c* illustrates a second one possible cam arrangement for use in the method of automated cleaning of the flat heat exchanger plates illustrated in FIG. 22*a*.
Figure 22A:
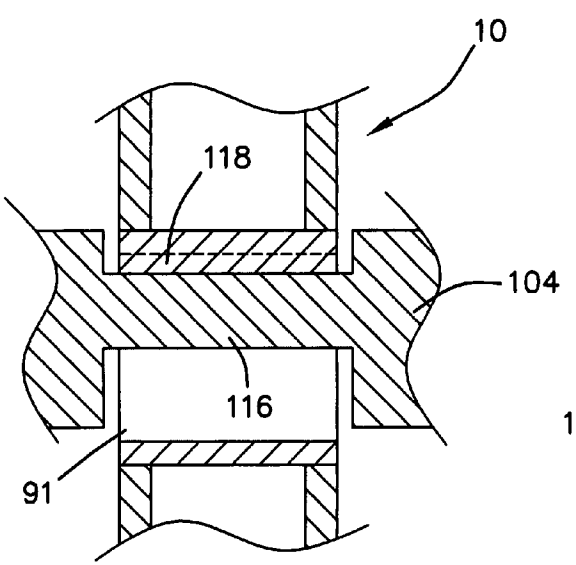
FIG. 22*a* illustrates an additional alternate method of automated cleaning of the flat heat exchanger plates of the present invention, where a plurality of cam elements are positioned along the length of a support bar.

Referring to FIGS. 22*a*, 22*b* and 22*c*, an additional example of the lift means 106 is illustrated and will be described. A cam 116 for each flat heat exchanger plate 10 can be incorporated into the support bar 104 and a cam follower 118 can be incorporated into each sleeve 91. Upon rotation of the support bar 104, for example by attaching an end 114 of the support bar to the shaft of a motor, the flat heat exchanger plates 10 are raised and lowered based upon the profile of each cam 116. Preferably, the maximum lift of each cam 116 is sequentially offset so that each flat heat exchanger plate 10 will be raised and lowered in predetermined sequence thus creating a shearing effect in the material between each adjacent flat heat exchanger plate. Turning to FIG. 22*b*, the cam profile of the cam 116 can include a steep profile section 120 which would cause the flat heat exchanger plate 10 to fall under the force of gravity a predetermined distance in accordance with the profile section 120. This fall would send a shock wave through the flat heat exchanger plate 10 and aid in the removal of the material from of the exterior surface thereof.

FIG. 22*c* illustrates an additional example of a cam profile for the cam 116 that could be used. In this example, the flat heat exchanger plates 10 would be raised and lowered in a predetermined sequence thus creating a shearing effect the material between each adjacent flat heat exchanger plate. The incorporation of a scraper element 122 into the bearing surface of the sleeve 91 would act to keep the surface of the cam 116 clear of material debris that could impede the operation of the cam.

Figure 23:
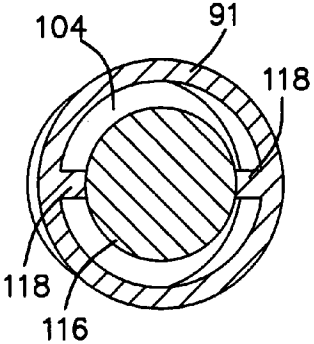
FIG. 23 illustrates an example of a cam arrangement to provide horizontal, back and forth movement of the flat heat exchanger plates.

Referring to FIG. 23, which illustrates an example of a cam arrangement including an eccentric cam 116 and cam followers 118 incorporated into the sleeve 91 of a plate coil. In this example, upon rotation of the support bar 104 the cam followers 118 would follow the profile of the cam 116 and flat heat exchanger plate 10 would translate horizontally back and forth. Such as described above a plurality of cams 116 would be incorporated along the length the support bar 104 with the maximum lift of each cam 116 offset from each other to create a shearing effect in material between each adjacent flat heat exchanger plate.

Figure 24:
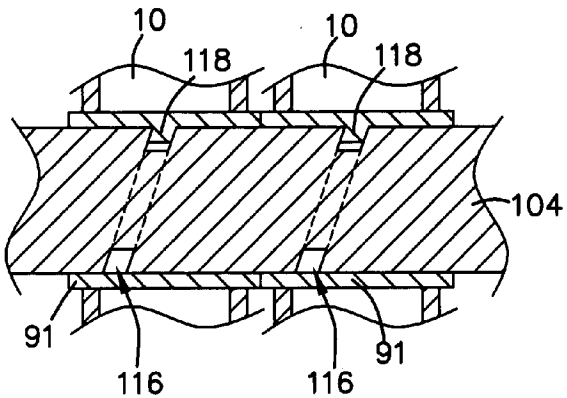
FIG. 24 illustrates an example of a cam arrangement to provide horizontal side-to-side movement of the flat heat exchanger plates.

Referring to FIG. 24, which illustrates an additional cam arrangement example including a plurality of lateral cams 116 cut into the support bar 104 and a cam follower 118 incorporated into the sleeve 91 of each flat heat exchanger plate 10. In this example, upon rotation of the support bar 104 the cam follower 118 would follow the profile of the lateral cam 116 cut into the support bar 104 and the flat heat exchanger plates 10 would translate horizontally from side-to-side in unison. In addition, the sleeves are extended to provide spacing for adjacent flat heat exchanger plates 10. The side-to-side, unison movement of the plate coils 10 aids in dislodging bulk material accumulated between adjacent flat heat exchanger plates.

A method of automated cleaning of the exterior surfaces of adjacent flat heat exchanger plate 10 is provided and includes the steps of providing at least two flat heat exchanger plates 10 arranged side-by-side in a spaced relationship, wherein the flat heat exchanger plates include a heat exchange medium inlet nozzle and an exit nozzle 20 and 22. Attaching the heat exchange medium inlet 20 and exit nozzles 22 to a heat exchange medium supply system 102, wherein the supply system includes a vacuum source which is attached to the heat exchange medium exit nozzles for creating a negative operating pressure within the flat heat exchanger plates. Isolating the vacuum source allowing the heat exchange medium to develop a predetermined desired hydrostatic pressure within the flat heat exchanger plates 10 to slightly inflate the flat heat exchanger plates to reduce the space between the flat heat exchanger plates and compress any bulk material that is accumulated on the exterior surfaces of the sides of the flat heat exchanger plates. And reconnecting the vacuum source to reestablish the negative operating pressure and thus deflating the flat heat exchanger plates 10 to increase the space between the plates and dislodge the compressed bulk material.

This method may also include connecting a pulsing 100 system between the vacuum source and the exit nozzles of the flat heat exchanger plates 10 to isolate the vacuum source and reconnect the vacuum source in a cyclic manner having a predetermined frequency.

While a preferred embodiment of the flat heat exchanger plate 10 has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A flat heat exchanger plate comprising:

a body having two opposing side sheets that are substantially smooth, two opposing longitudinal edges and two opposing transverse edges where the two side sheets are sealed to each other along the borders of the two transverse edges and the two longitudinal edges, defining an open interior space;

a heat exchange medium inlet nozzle in fluid communication with the open interior space;

a heat exchange medium exit nozzle in fluid communication with the open interior space at least one pressure resistor member positioned within the open interior space with one end thereof attached to the interior surface of one side sheet; and at least one flow diverter positioned within the open interior space to create a heat exchange medium flow path, wherein said at least one flow diverter is a strip of material having at least one bend and includes at least one hole formed therethrough along the center line thereof, and said at least one pressure resistor member is received by at least one hole to position and retain said flow diverter within the interior space.

2. The flat heat exchanger plate of claim 1, wherein said at least one pressure resistor member and at least one pressure restraint member is strategically positioned within the interior space to aid in the placement and retention of said at least one flow diverter.

3. The flat heat exchanger plate of claim 1, wherein said heat exchange medium exit nozzle is attached to a vacuum source and said heat exchange medium inlet nozzle is attached to a source of heat exchange medium.

4. The flat heat exchanger plate of claim 1, further comprising:

at least one support lug extending from one edge of said body.

5. The flat heat exchanger plate of claim 1, further comprising:

at least one indentation formed into one edge of said body.

6. The flat heat exchanger plate of claim 1, further comprising:

at least one lifting lug extending from the top of said body.

7. The flat heat exchanger plate of claim 1, further comprising:

at least one location lug extending from one edge of said body.

8. The flat heat exchanger plate of claim 1, wherein said body includes at least one support hole formed through the side sheets thereof.

9. A bulk material heat exchanger comprising:

a plurality of flat heat exchanger plates arranged side-by-side in a spaced relationship, each of said flat heat exchanger plates having a body with two opposing side sheets that are substantially smooth, two opposing longitudinal edges and two opposing transverse edges where the two side sheets are sealed to each other along the borders of the two transverse edges and the two longitudinal edges, defining an open interior space, a heat exchange medium inlet nozzle in fluid communication with the interior space, a heat exchange medium exit nozzle in fluid communication with the open interior space, at least one pressure resistor member positioned within the open interior space with one end thereof attached to the interior surface of one side sheet, and at least one flow diverter positioned within the open interior space to create a heat exchange medium flow path, wherein said at least one flow diverter is a strip of material having at least one bend and includes at least one hole formed therethrough along the center line thereof, and said at least one pressure resistor member is received by at least one hole to position and retain said flow diverter within the interior space;

a heat exchange medium supply manifold attached to each heat exchange medium inlet nozzle of each flat plate heat exchanger coil, said heat exchange medium supply manifold attached to a heat exchange medium supply system; and a heat exchange medium return manifold attached to each heat exchange medium exit nozzle of each flat plate heat exchanger coil, said heat exchange medium return manifold attached to a vacuum source so as to draw a quantity of heat exchange medium from the supply thereof through each flat plate heat exchanger coil and return the heat exchange medium back to the heat exchange medium supply system.

10. The bulk material heat exchanger of claim 9, wherein each of said flat heat exchanger plates further includes at least one support lug extending from one edge of said body.

11. The bulk material heat exchanger of claim 9, wherein each of said flat heat exchanger plates further includes at least one indentation formed into one edge of said body.

12. The bulk material heat exchanger of claim 9, wherein each of said flat heat exchanger plates further includes at least one lifting lug extending from the top of said body.

13. The bulk material heat exchanger of claim 9, wherein each of said flat heat exchanger plates further includes at least one support hole formed through the side sheets thereof.

14. The bulk material heat exchanger of claim 9, further comprising:

at least one removable seal positioned between the sides sheets of two adjacent flat heat exchanger plates.

15. The bulk material heat exchanger of claim 9, wherein the each of the flat heat exchanger plates includes at least one pressure restraint member positioned within the open interior space.

* * * * *